US006119279A

United States Patent [19]

Haslbeck

[11] Patent Number: 6,119,279

[45] Date of Patent: Sep. 19, 2000

[54] SWIM GOGGLES WITH TWISTABLE NOSEBRIDGE

[75] Inventor: Joseph Haslbeck, West Vancouver, Canada

[73] Assignee: Sharp Plastics Manufacturing Ltd., Delta, Canada

[21] Appl. No.: 09/226,560

[22] Filed: Jan. 7, 1999

[51] Int. Cl.[7] ..... A61F 9/02

[52] U.S. Cl. ..... 2/445; 2/428; 351/43; 351/126

[58] Field of Search ..... 2/428, 430, 445, 2/446, 454; 351/43, 124, 126

[56] References Cited

U.S. PATENT DOCUMENTS

| | | | |
|---|---|---|---|
| 1,199,988 | 10/1916 | Ihrcke et al. | 351/43 |
| 3,791,721 | 2/1974 | Helfrich | 351/44 |
| 4,264,987 | 5/1981 | Runckel | 2/428 |
| 5,459,882 | 10/1995 | Yamamoto | 2/428 |
| 5,488,441 | 1/1996 | Pomatti | 351/156 |
| 5,502,844 | 4/1996 | Alvarado | 2/445 |
| 5,603,125 | 2/1997 | Chou | 2/428 |
| 5,650,866 | 7/1997 | Haslbeck | 359/43 |
| 5,857,221 | 1/1999 | Geneve et al. | 2/428 |
| 5,880,808 | 3/1999 | Devercelli | 351/132 |

FOREIGN PATENT DOCUMENTS

WO 98 48905 11/1998 WIPO .

*Primary Examiner*—John J. Calvert
*Assistant Examiner*—Katherine Moran
*Attorney, Agent, or Firm*—Christie, Parker & Hale, LLP

[57] ABSTRACT

Eye goggles comprising left hand and right hand eyepieces and a nosebridge interconnecting inner portions of the eyepieces. The nosebridge has at least two filaments, each filament having left hand and right hand end portions cooperating with respective eyepieces. A headband cooperates with outer portions of the eyepieces to extend therebetween. Spacing between the eyepieces is adjusted by positioning the goggles in a generally operative position and rotating one eyepiece relative to the other eyepiece through at least one revelation so that portions of the filaments are twisted together, thus tending to reduce spacing between the eyepieces.

22 Claims, 6 Drawing Sheets

SWIM GOGGLES WITH TWISTABLE NOSEBRIDGE

BACKGROUND OF THE INVENTION

The invention relates to eye goggles, in particular to swim goggles that can be manufactured for a relatively low cost and can provide a comfortable and watertight seal and accommodate a wide variety of faces.

Swimming goggles have been known for many years and one common type comprises two eyepieces which are adjustably interconnected by a relatively thin and flexible plastic strap, serving as a nosebridge, and a headband to pass around the head to hold the goggles on the face. The nosebridge has opposite outer ends which are received within complementary openings provided in peripheral rims surrounding lenses of the eyepieces. The outer ends are provided with "barb-like" steps which engage complementary projections or edges of the openings in the eyepiece rims to locate the nosepiece with respect to the eyepieces. To accommodate persons having eyes of different spacings, at least one end of the strap is moved into or out of the respective eyepiece opening to permit a different barb-like step to engage the edge of the opening so as to permit incremental adjustment of the spacing between the eyepieces. To permit easy adjustment of the strap within the opening, there is adequate clearance between the strap and edge to facilitate engagement and disengagement of the barb-like steps. However, even when the edge or projection is engaged by the strap, there can be excessive movement between the strap and the opening which can cause excessive instability of the eyepieces engaging the wearer's face. While the instability can be reduced by increasing the tension of the headband, an excessive increase in tension forces the eyepieces into the wearer's eye sockets, increasing discomfort for the wearer.

Most eyepieces have face engaging rims provided with soft gaskets to improve comfort by cushioning the eyepieces against the face and sealing thereagainst. The gasket is commonly an expanded or "foamed" plastic material, or a relatively thin soft rubber-like material which has a feather edge which engages the face to provide a seal therewith. Both types of gasket material can deform excessively when subjected to excessively high headband tension in an attempt to improve stability of the eyepieces engaging the face, and this deformation decreases the cushioning of the gasket, causing discomfort to the wearer.

The looseness between the nose strap and the opening in the eyepieces can also be a problem when the goggles are removed from the wearer's head, and thus are no longer subjected to headband tension. In this instance, random movements of the goggles can cause inadvertent movement between the nosebridge strap and the opening which can disengage the barb or step from the edge of the opening, thus disturbing the original eyepiece spacing. One example of swimming goggles having a flexible nosebridge having a series of barb-like steps at outer ends thereof is shown in U.S. Pat. No. 5,459,882 (Yamamoto).

To avoid use of the above "barbed" flexible nosebridge, other structures have been devised to locate eyepieces securely against the face, while permitting adjustment of spacing therebetween. In this regard, U.S. Pat. No. 5,502,844 (Alvarado) discloses swimming goggles with eyepieces connected together by two lengths of string passing through openings adjacent inner portions of the eyepieces. U.S. Pat. No. 5,603,125 (Chou) discloses a pair of goggles in which eyepieces thereof are interconnected by a simple knotted loop of string passing through eyelets adjacent inner portions of the eyepieces. In both these references, untying and retying the knot presumably adjusts the length of the string and thus spacing between the eyepieces. In Applicant's opinion, these two types of goggles can be uncomfortable to wear as tension in the portions of string interconnecting the eyepieces causes the string to extend in a series of straight lines between the eyepieces. Taut lengths of string would tend to interfere with the wearer's nose, particularly if the nose is relatively large and projects beyond a plane containing openings receiving the string. Also, U.S. Pat. No. 3,791,721 (Helfrich) discloses a pair of compact eye goggles for protection against high intensity light radiation in which eyepieces are drawn together by lengths of soft elastic cord or band which are loosely threaded through a series of eyelets extending peripherally around the eyepieces. These goggles are not for swimming as they would not be watertight, and thus would not be appropriate for the present use.

SUMMARY OF THE INVENTION

The invention reduces the difficulties and disadvantages of the prior art by providing swim goggles in which eyepieces thereof are interconnected by a simple flexible nosebridge which permits adjustment of spacing between the eyepieces without separation or disconnection of the nosebridge from the eyepieces. For many persons, the nosebridge has sufficient length and flexibility to hold the eyepieces at a satisfactory spacing to accommodate their eye spacing. For individuals whose eyes are closer together, the nosebridge can be twisted to shorten effective length of the nosebridge, thus causing the eyepieces to be drawn towards each other to reduce spacing therebetween and thus accommodating eyes which are more closely spaced together. The nosebridge has end portions which are rigidly connected to the eyepieces to essentially prevent movement therebetween, and have sufficient stiffness to form an arch between the two eyepieces, thus providing sufficient clearance for the nose to essentially eliminate discomfort due to the nosebridge contacting the wearer's nose.

One embodiment of the invention relates to a nosebridge for eye goggles comprising left hand and right hand connector portions, which are connectable to respective eyepieces of the goggles, and first and second filaments. Each filament has left and right hand end portions connected to the respective connector portions, the end portions being spaced laterally apart. In one embodiment, preferably the end portions have root portions which are non-hingedly connected to the connector portions so as to extend essentially rigidly therefrom.

Another embodiment of the invention relates to eye goggles comprising left hand and right hand eyepieces having inner portions and outer portions, a nosebridge for interconnecting the inner portions of the eyepieces, and a headband cooperating with outer portions of the eyepieces to extend therebetween. The nosebridge has left hand and right hand connector portions and first and second filaments, each filament having left hand and right hand end portions connected to the respective connector portions. The end portions of each filament connected adjacent each respective connector portion are spaced laterally apart, and preferably have root portions which are non-hingedly connected to the connector portions so as to extend essentially rigidly therefrom.

Another embodiment of the invention relates to a method of adjusting spacing between two eyepieces of eye goggles in which the eyepieces are interconnected with first and second filaments. The method comprises:

positioning the goggles in a generally operative position, and rotating one eyepiece relative to the other eyepiece through at least one revolution so that portions of the filaments are twisted together, thus tending to reduce spacing between the eyepieces.

In one embodiment, adjacent end portions of the filaments are spaced generally laterally apart, and the method is further characterized by permitting at least said end portions of the filaments to remain spaced apart following rotation of the eyepieces.

A detailed disclosure following, related to drawings, describes a preferred embodiment and method according to the invention, which are capable of expression in structure and method other than those particularly described and illustrated.

DETAILED DESCRIPTION OF THE INVENTION

FIGS. 1–3

Figure 1:
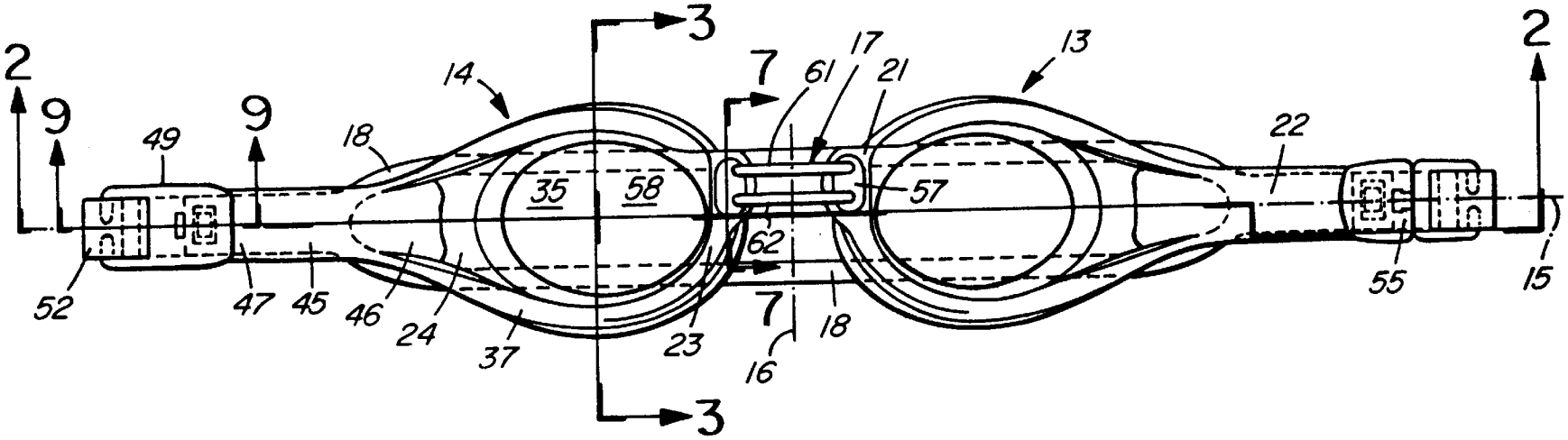
FIG. 1 is a simplified front elevation of a pair of swim goggles according to the invention, with eyepieces thereof shown in an approximate operative position and interconnected with a headband.

A pair of swim goggles 10 according to the invention, comprises left hand and right hand eyepieces 13 and 14, a nosebridge 17 and a headband 18. The eyepieces are disposed generally symmetrically about a longitudinal axis 15 and a transverse axis 16 when the goggles are disposed in an approximately normal operative position when worn on a wearer. The eyepiece 13 has inner and outer portions 21 and 22 and the eyepiece 14 has inner and outer portions 23 and 24 respectively.

The eyepieces 13 and 14 are essentially identical to each other, but mirror images of each other about the axis 16, and thus only the eyepiece 14 will be described in more detail. The right hand eyepiece 14 has a transparent eyepiece lens 35 and an eyepiece frame 37, the frame extending peripherally around a rim 38 of the lens. The lens 35 is a tough, scratch resistant, essentially rigid transparent plastic, whereas the frame 37 is a relatively soft and yielding rubber-like plastic which has a lens engaging portion 40 molded intimately to the rim 38 to provide an essentially watertight seal therewith with a strong mechanical connection. This can be best attained by injection of the eyepiece frame 37 around the lens 35 in a suitable molding procedure. The frame 37 has a face engaging portion 42 which flairs outwardly to a feather edge to provide a comfortable and essentially watertight engagement with a wearer's face, not shown.

The eyepiece frame 37 has an outwardly extending flexible strap 45 having a proximal end 46 integrally molded into the frame 37, and a distal end 47 connected to a swivel connector 49 which in turn is connected to a right hand end portion 52 of the headband 18. The headband has a left hand end portion 53 which similarly connects with a left hand swivel connector 55, which in turn cooperates with the eyepiece 13 through a flexible strap 56. Thus, it can be seen that the headband 18 cooperates with the outer portions 22 and 24 of the eyepieces 13 and 14 respectively to extend therebetween, and thus to hold the goggles 10 on the wearer's head in a conventional manner.

The nosebridge 17 interconnects the inner portions 21 and 23 of the eyepieces, and has left hand and right hand connector portions 57 and 58 and first and second filaments 61 and 62 respectively. In FIG. 2, it can be seen that the filaments 61 and 62 are deformed into a generally U-shaped arch when the goggles are disposed in a generally operative position as shown. In this position the eyepiece lenses are generally coplanar with each other, ie. are within a lens plane containing the longitudinal axis 15 (see FIG. 2), and disposed symmetrically about the longitudinal axis as viewed in FIG. 1. In this way, when the goggles engage a wearer's face in the operative position, a wearer's nose (shown in broken outline at 65 in FIG. 2) is generally clear of the nosebridge. Usually, portions of the nose adjacent the cheeks are engaged by the face engaging portions of the eyepiece frames adjacent the nose, while the nosebridge 17 extends around and clear of the nose, thus avoiding direct and possibly painful contact with the nose. Depending on the shape of the wearer's nose, the nose could be contacted lightly by the filaments 61 and 62, but nevertheless, the contact is relatively gentle due to the arch-like shape and resulting stiffness of the nosebridge 17 when in the operative position as shown. In this configuration, the filaments 61 and 62 appear to be generally parallel to each other when viewed as in FIG. 1, and a nominal spacing 67 (see FIG. 2) between the eyepieces approximates to a maximum which is dependent somewhat on headband tension.

FIGS. 4–6

Figure 4:
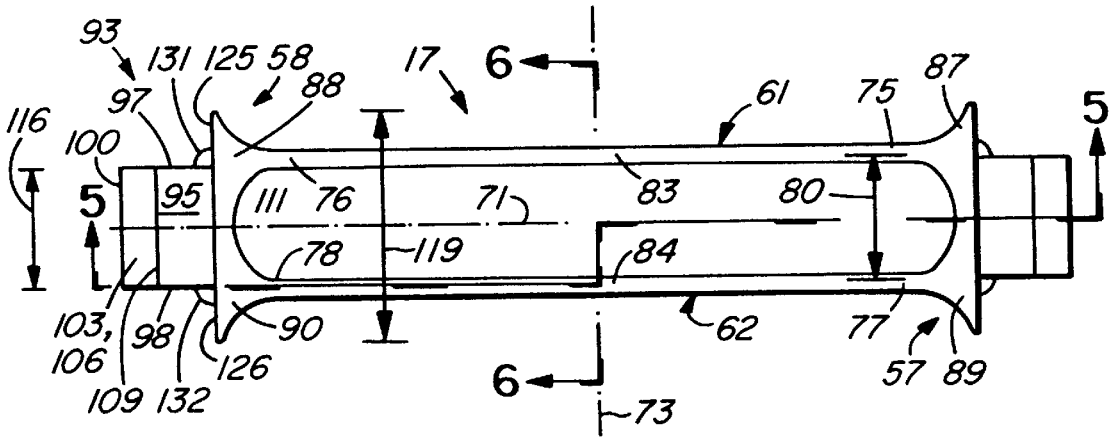
FIG. 4 is a simplified front elevation of a nosebridge according to the invention shown in a non-operative straightened orientation as delivered from a molding die.
Figure 5:
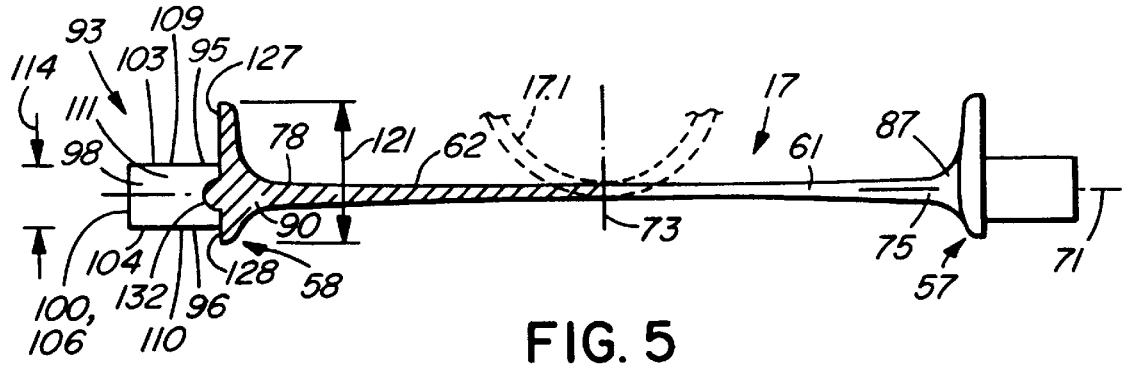
FIG. 5 is a simplified section on line 5—5 of FIG. 4.

Referring to FIGS. 4 and 5, the nosebridge 17 is preferably produced by an injection molding process in which a moldable plastic material is injected into a complementary molding cavity so that, as molded, the filaments 61 and 62 are disposed generally symmetrically about a longitudinal nosebridge plane or axis 71, and are disposed generally parallel to each other. Within the molding cavity, the nosebridge is also generally symmetrical about a transverse plane 73 disposed perpendicularly to the plane 71 as best seen in FIG. 5. Mild distortion of the nosebridge after ejection from the molding cavity is not a problem, and the plastic material is selected so as to permit bending of the nosebridge to assume a generally U-shape, shown partially in broken outline in FIG. 5 at 17.1 and in full outline in FIG. 2 at 17 when the goggles are in the operative position as previously described. Thus, as initially manufactured, the filaments 61 and 62 are generally parallel to each other as shown in FIG. 4 and are generally coplanar with each other as shown in FIG. 5.

The filament 61 has left hand and right hand end portions 75 and 76, and the filament 62 has left hand and right hand end portions 77 and 78 respectively, the appropriate end portions being connected to the left hand and right hand connector portions 57 and 58 respectively. The end portions of the filaments connected adjacent each respective connector portion are spaced laterally apart at a lateral spacing 80, as measured between centre lines of the filaments. Actual surface-to-surface spacing between filaments varies slightly along the length of the axis 71 because the filaments 61 and 62 taper smoothly and uniformly from positions generally adjacent the connector portions inwardly towards respective central portions 83 and 84 respectively. This tapering will be described in greater detail when considering the specific physical and dimensional properties of the filaments.

In addition, the end portions 75 and 76 of the filament 61 have root portions 87 and 88 respectively which resemble generally conical fillets which flair smoothly outwardly from the adjacent end portion 75 and 76 of the filament to merge smoothly with the respective connector portions 57 and 58. Similarly, the end portions 77 and 78 of the filament 62 flair outwardly through root portions 89 and 90 which also resemble generally similar conical fillets.

Thus, end portions of the filaments have conical fillets which are smoothly curved to provide a rugged and stiffened connection between the end portion of each filament and the appropriate connector portion. In this way, the root portions provide a relatively non-yielding connection between the filaments and connector portions. Thus, the end portions of each filament have root portions which are non-hingedly connected to the connector portions so as to extend essentially rigidly therefrom generally similarly to a cantilevered beam. Thus it can be seen that the generally conical fillet of each root portion serves as a means to provide an essentially rigid connection between each end portion of the filament and a respective connector portion.

The right hand connector portion 58 has a projection 93 which has a generally rectangular cross-section defined by first and second broad faces 95 and 96 and first and second narrow faces 97 and 98, which terminate at an end face 100. The narrow faces 97 and 98 are inclined to the longitudinal nosebridge plane 71 at very shallow angles (FIG. 4), and the broad faces 96 and 97 are inclined at similar shallow angles to a plane containing the axis 71 (FIG. 5). The similar shallow angles are required in the manufacturing process and serve as draft angles to facilitate ejection of the finished part from the mould. The angles are typically between about 2 and 3 degrees and are not further described. Thus the pair of narrow faces, and the pair of broad faces, are essentially parallel to each other.

In addition, the broad faces 95 and 96 have bulge portions 103 and 104 respectively which are provided adjacent a distal portion 106 of the projection. The projection has a proximal portion 111 which is adjacent the root portions 88 and 90 of the filaments 61 and 62 respectively and has a thickness which is somewhat smaller than thickness of the distal end portion 106, ie spacing between the bulge portions 103 and 104 adjacent the distal end portion. The bulge portions 103 and 104 are separated from the proximal portion 111 by oppositely located first and second projection steps 109 and 110 respectively, which face inwardly towards the proximal portion of the projection. The steps are typically between about 0.2 millimeters and 0.5 millimeters and the portions of a particular broad face on either side of the respective step are generally parallel to each other. Thus the broad faces are stepped with the shallow projection steps, whereas the narrow faces are essentially plane.

The root portions 88 and 90 of the filaments have an overall or maximum size greater than the proximal end portion 111 of the projection to provide a connector shoulder portion extending around the proximal end portion of the projection as follows. As seen in FIG. 5, space 114 between the broad faces 95 and 96 adjacent the proximal end portion of the projection defines thickness 114 of the proximal end portion of the projection. Similarly as seen in FIG. 4, space 116 between narrow faces 97 and 98 defines width 116 of the projection adjacent the proximal end portion 111. As seen in FIG. 4, overall length 119 of the root portions 88 and 89 is greater than the width 116 of the projection, and thus provides first and second connector shoulders 125 and 126 extending generally perpendicularly from the narrow faces 97 and 98 respectively. As seen in FIG. 5, overall width 121 of the root portions is greater than the thickness 114 of the proximal end portion of the projection to provide third and fourth connector shoulders 127 and 128 extending from the broad faces 95 and 96 respectively of the projection. The shoulder 127 is larger than the shoulder 128, whereas the shoulders 125 and 126 are generally equal. The connector shoulders 125 through 128 are shown to be coplanar with each other, although this is not essential as will be described.

First and second hemispherical fillets 131 and 132 extend between the first narrow face 97 and the first connector shoulder 125, and the second narrow face 98 and the second connector shoulder 126 respectively. The hemispherical fillets cooperate with other structure for centering and fitting purposes as will be described with respect to FIGS. 7 and 8.

The left hand connector portion 57 is essentially identical to the right hand connector portion 58 and thus is not described in detail.

Figure 7:
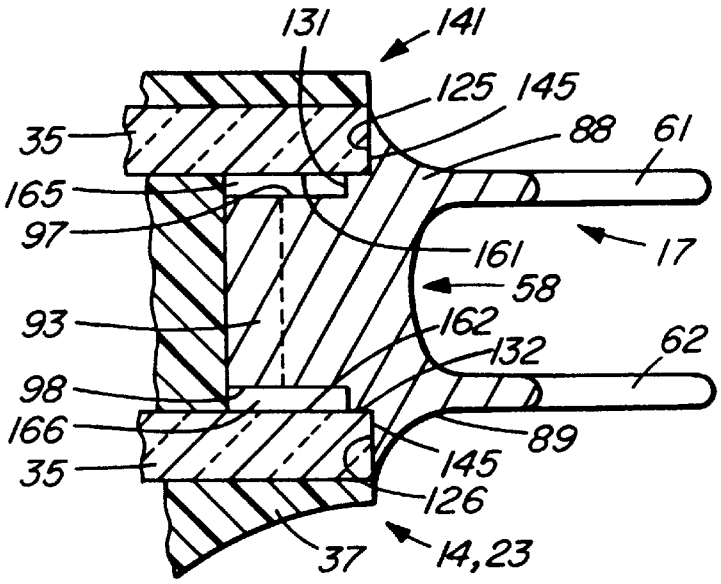
FIG. 7 is a simplified fragmented section on line 7—7 of FIG. 1 at highly enlarged scale.
Figure 8:
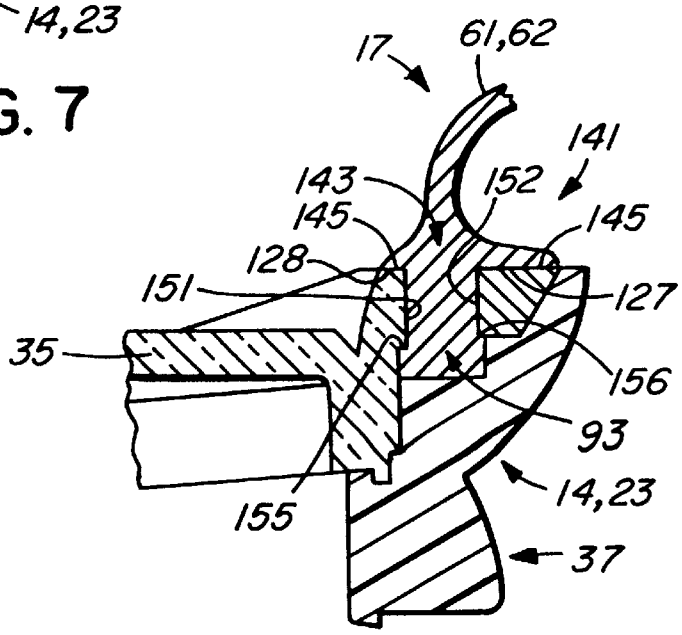
FIG. 8 is a simplified fragmented section of a detail outlined by circle 8 of FIG. 2.

FIG. 7 and 8 With References to FIGS. 4 and 5

Referring to FIG. 8, the inner portion 23 of the right hand eyepiece 14 has an integral boss 141 which extends generally normally and outwardly from the wearer's face, not shown, to serve as a joint portion to connect to the nosebridge 17 as follows. The boss or joint portion 141 has a rectangular cross-sectioned recess 143 surrounded by a generally open rectangular shaped recess shoulder 145 located closely adjacent the recess, and disposed generally parallel to an outer surface of the eyepiece lens 35. The projection 93 is fitted within the recess 143 to secure the nosebridge to the eyepiece, and in general is retained therein permanently, although if sufficient force is used, the projection can be removed as will be explained. The recess 143 is disposed generally perpendicularly to the recess shoulder when viewed in FIGS. 7 and 8, and thus is disposed generally normally to planes of the recess shoulder and the lens 35. In FIG. 7, it can be seen that opposite portions of the recess shoulder 145 extend on two opposite sides of the recess and that the shoulder portions are coplanar with each other. Similarly, in FIG. 8, it can be seen that similar opposite portions of the recess shoulder 145 extend on the remaining two opposite sides of the recess, with all the recess shoulder portions being coplanar with each other.

As previously described with respect to FIGS. 4 and 5, the connector shoulders 125–128 are coplanar with each other and thus, when the projection 93 is fitted within the recess 143, the connector shoulders 125–128 are generally complementary with the recess shoulder 145 and engage appropriate adjacent portions thereof to provide an essentially rigid connection between the nosebridge and the eyepiece, ie. with essentially no "lost motion" between the recess and projection.

Referring specifically to FIG. 8, the recess 143 has first and second oppositely facing broad faces 151 and 152 having first and second recess steps 155 and 156 disposed oppositely to each other across the recess. The first recess step 155 divides the first broad recess face 151 into a proximal portion adjacent the recess shoulder 145, and a distal portion on an opposite side of the step. The proximal and distal portions are generally parallel to each other and separated by depth of the step, which is typically between 0.3 millimeters and 0.6 millimeters. Thus the depth of the first recess step has a range slightly larger than range of the first projection step, but this is to increase manufacturing tolerances to facilitate manufacturing, and thus the first recess step is essentially complementary to the first projection step. On the other hand, the second recess step 156 is a right-angled corner separating a corresponding proximal portion of the second broad face from a distal portion, the distal portion being generally parallel to the shoulder 145 and defining a lower edge of the boss or joint portion 141. The second recess step also provides adequate manufacturing tolerances and is essentially complementary to the second projection step.

Spacing between the proximal portions of the broad recess faces 151 and 152 is generally equal to the space 114 between the broad faces 95 and 96 of the projection 111 which, as shown in FIG. 5, defines the thickness of the proximal end portion of the projection. Clearly, space between the bulge portions 103 and 104 of the distal portion of the projection 111 is sufficient to permit insertion of the projection through the proximal portion of the recess. Thus, it can be seen that there is a relatively snug fit between the broad faces of the recess and the broad faces of the projection adjacent the proximal portion thereof, with a cooperating interference between the projection steps 109 and 110 and the respective complementary recess steps 155 and 156.

Referring specifically to FIG. 7, the recess 143 has first and second narrow faces 161 and 162 respectively which are spaced at a distance greater than the space 116 between the narrow faces 97 and 98 of the projection 111, which space, as seen in FIG. 4, defines width of the projection 111. This difference in size provides first and second clearances 165 and 166 adjacent the narrow faces 97 and 98 of the projection respectively which contrasts with the relatively snug fit between the broad faces of the recess and the projection adjacent the proximal end thereof. The projection is centered within the recess with respect to the narrow faces 161 and 162 thereof by the fillets 131 and 132 so that the clearances 165 and 166 are generally equal in size.

The first and second recess steps 155 and 156 are spaced, from the recess shoulder 145 by a spacing generally similar to spacing of the projection steps 109 and 110 from the third and fourth connector shoulders 127 and 128 so that, when the projection is received in the recess, each projection step is engaged with the respective adjacent recess step to hold the projection snugly in the recess.

As best seen in FIG. 7, the generally hemispherical fillets 131 and 132 are shown partially deformed and closely adjacent corners defined by the recess shoulders 145 and the narrow faces 161 and 162. The fillets are deformed slightly when the projection is inserted into the recess to permit resilient engagement of the complementary projection steps and recess steps, so that forces generated by deflection of the fillets tend to hold the complementary steps in engagement with each other.

In summary, it can be seen that the recess has first and second broad recess faces with first and second recess steps respectively which face towards each other, and the bulge portions 103 and 104 of the projection have first and second projection steps which are engaged by the first and second recess steps of the recess to hold the recess shoulders in engagement with the connector shoulders and thus hold the projection in the recess. The faces 151, 152, 161 and 162 of the recess are comprised of the hard, transparent material of the eyepiece lens and can deform slightly when engaged by the relatively tough but slightly more resilient material of the nosepiece projection. The materials can deform sufficiently to permit resilient insertion of the nosepiece projection into the recess, with essentially negligible chances of inadvertent separation of the nosepiece from the eyepieces. However, if necessary, it is possible to separate the projections from the respective recesses by inserting a thin blade to carefully disengage the steps from each other, and then carefully yet forcefully separating each projection from its respective recess.

FIGS 9–1

Figure 9:
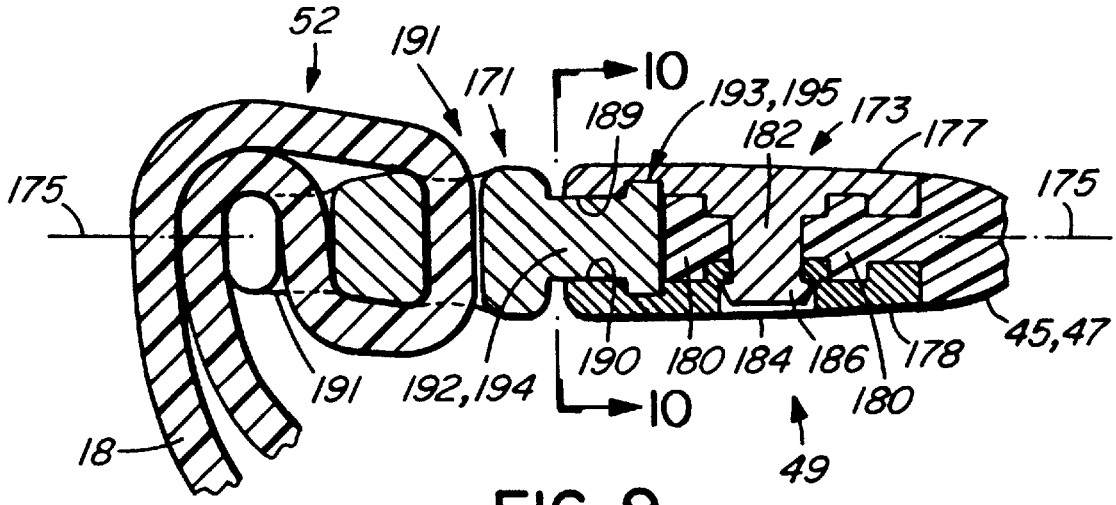
FIG. 9 is a simplified fragmented section on line 9—9 of FIG. 1 showing a swivel connector at an enlarged scale.

The right hand swivel connector 49 has a band anchor portion 171 connected to the end portion 52 of the headband 18, and an eyepiece anchor portion 173 connected to a distal end 47 of the right hand strap 45 extending from the outer portion of the eyepiece 14. Thus, the eyepiece anchor portion cooperates with an outer portion of the eyepiece through the swivel connector. The anchor portions are rotatable relative to each other to permit swivelling about a longitudinally aligned swivel axis 175 interconnecting the anchor portions as shown in FIG. 9. The eyepiece anchor portion 173 comprises first and second swivel body portions 177 and 178 which have inner surfaces which define a cavity to receive an extreme end portion 180 of the distal end 47 of the strap. The extreme end portion has a shape complementary to the cavity of the swivel body portions 177 and 178 and is received therebetween to provide a secure connection with the strap 45. The first swivel body portion 177 has a connector pin 182 which extends transversely through an opening in the extreme end position 180 of the strap, ie. across the axis 175, and is received within a complementary pin opening 184 in the second swivel body portion 178. The pin has a head 186 which has a barb-like connection which is releasably connected to a complementary shoulder extending around the sidewall of the pin opening 184 so as to hold the two body portions closely together and sandwich the distal end 47 therebetween. The swivel body portions 177 and 178 also have complementary first and second concave journal halves 189 and 190 which cooperate with each other to form an annular female swivel journal.

The band anchor portion 171 has a plurality of parallel transverse slits 191 to receive and fictionally retain the end portion 52 of the headband to permit easy adjustment thereof as is well known, and thus requires no further comment. The anchor portion 171 also includes a spigot 193 having a cylindrical spigot root 194 to form a male swivel journal complementary to the female swivel journal. The spigot also has a spigot head 195 which is larger than the spigot root 194 and is generally complementary to a groove disposed adjacent the journal halves 189 and 190, when the spigot is fitted in the eyepiece anchor portion 173. The spigot head 195 prevents unintentional axial separation of the spigot or male journal from the female swivel journal when the anchor portions 171 and 173 are connected together.

Figure 10:
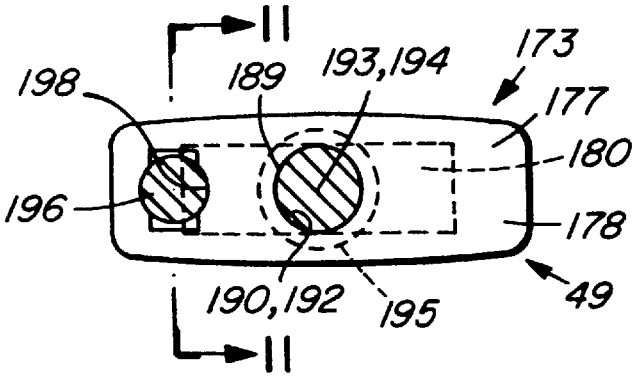
FIG. 10 is a simplified section on line 10—10 of FIG. 9.
Figure 11:
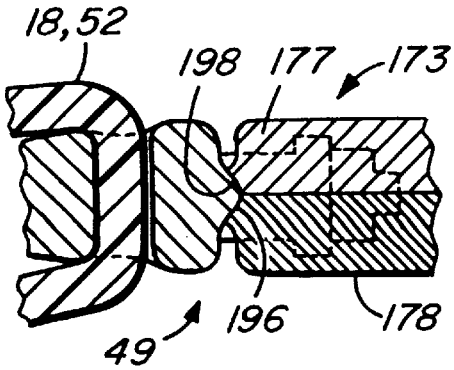
FIG. 11 is a simplified fragmented section on line 11—11 of FIG. 10.

As best seen in FIGS. 10 and 11, the band anchor portion 171 also includes a partially spherical projection 196 which extends towards the eyepiece anchor portion 173. When the anchor portions are laterally aligned as shown in FIGS. 10 and 11, is received within a complementary partially spherical recess 198 provided in an adjacent end face of the eyepiece anchor portion 173. The depth of the recess 198 and size of the projection 196 is such that the projection is received in the recess in a slight interference fit to resist light rotational forces which generate a torque between the anchor portions, thus maintaining the anchor portions laterally aligned as shown in FIGS. 9 and 11. However, if sufficient torque is applied to one of the anchor portions, there is sufficient resilience in the swivel connector to permit the projection 196 to "snap out" of the recess 198 to permit swivelling of the anchor portions relative to each other through almost a complete revolution until there is again interference between the spherical portion on the anchor portion 171 and the eyepiece anchor portion 173. Resistance to rotation can easily be overcome, permitting the projection 196 to once again engage the recess 198. In normal operation, the anchor portions 171 and 173 are laterally aligned as shown, and the headband 18 is free of any twists. The projection 196 and recess 198 serve as a releasable latch for the swivel connector to maintain the swivel connector in a particular orientation by restraining the anchor portions against inadvertently swivelling relative to each other.

FIGS. 1, 2, 12 and 13

Figure 2:
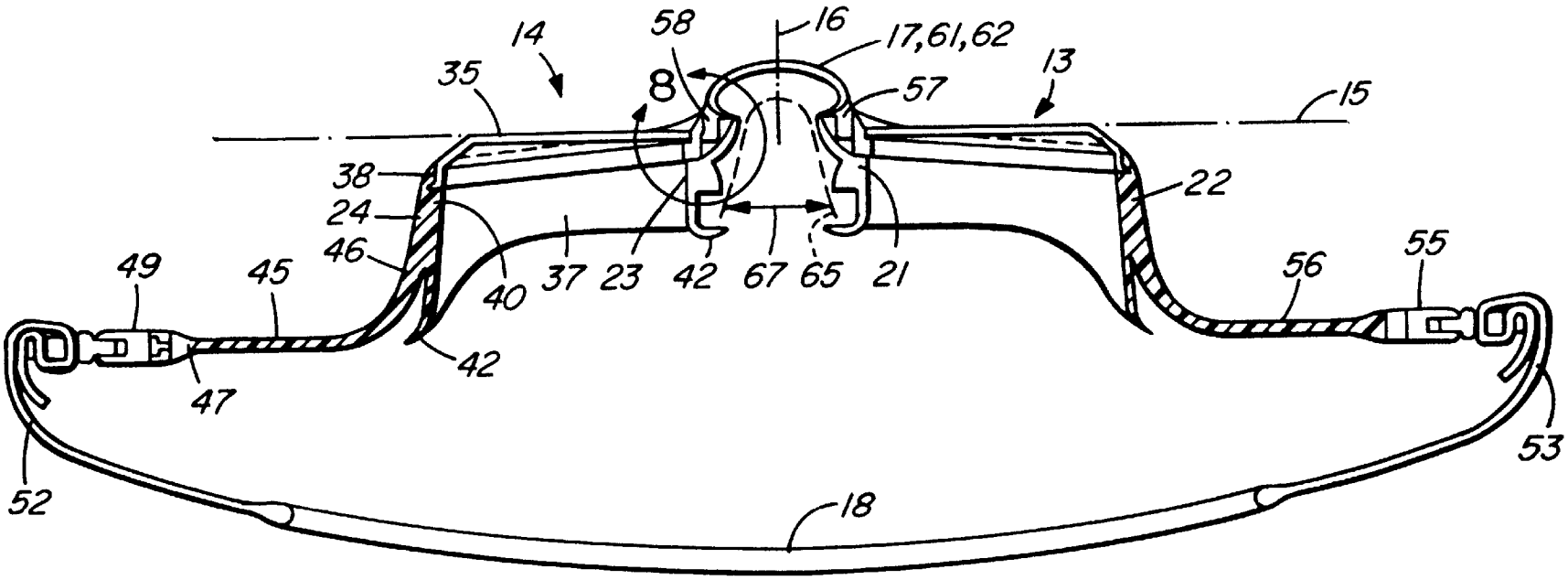
FIG. 2 is a simplified section on line 2—2 of FIG. 1.
Figure 3:
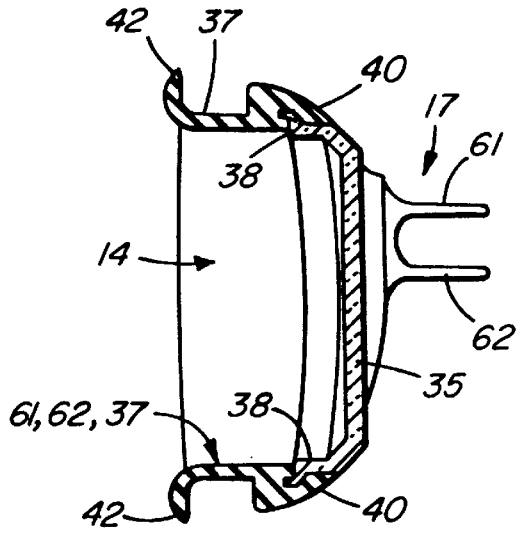
FIG. 3 is a simplified section on line 3—3 of FIG. 1.

Referring to FIGS. 1 and 2, when the filaments 61 and 62 of the nosebridge are generally parallel to each other as viewed in FIG. 1, the nominal spacing 67 (FIG. 2) between the inner portions of the eyepieces 13 and 14 approaches maximum, which is somewhat dependent on headband tension and shape of the wearer's face. In this configuration, usually spacing between the eyes of over one half of the users can easily be accommodated by small adjustments of the nosebridge, ie. cold bending of the nosebridge filaments to adjust locations of the eyepieces on the face. However, for persons having smaller faces, or more closely spaced eyes, it is preferable to provide a means of reducing the nominal spacing 67 so as to draw the eyepieces more closely together as follows.

Figure 12:
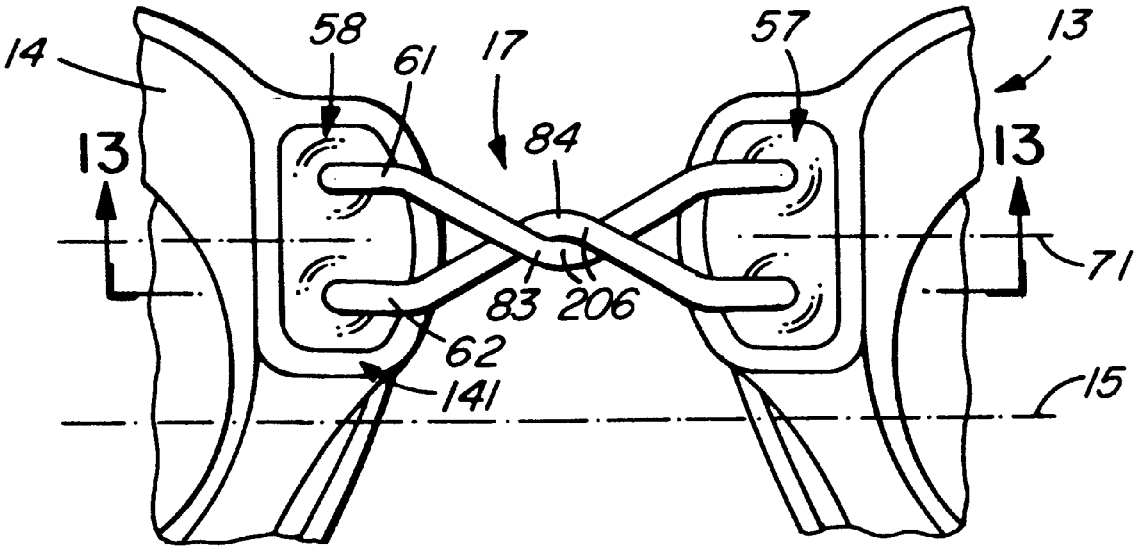
FIG. 12 is a simplified fragmented front elevation of the nosebridge and adjacent portions of eyepieces at enlarged scale, the nosebridge being shown twisted to reduce eyepiece separation.
Figure 13:
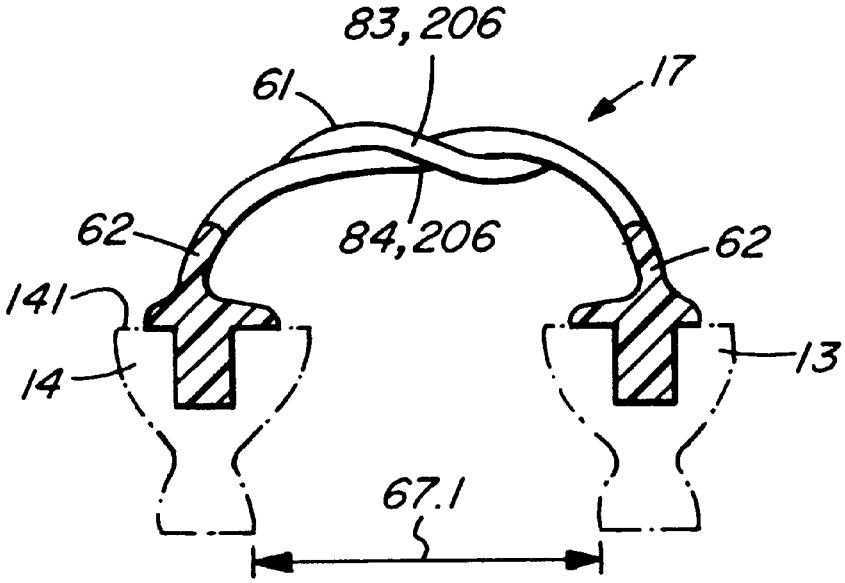
FIG. 13 is a simplified fragmented section generally on line 13—13 of FIG. 12 showing main portions of the nosebridge.

Referring to FIGS. 12 and 13, the eyepieces are drawn together by twisting one eyepiece relative to the other about the nosebridge longitudinal axis 71 (a portion of which is parallel to the goggles axis 15) so that the filaments 61 and 62 become intertwined at twisted portions 206 as shown. To enable the goggles to be correctly fitted to the face, the number of turns of one eyepiece with respect to the other eyepiece must be a whole number, and typically between 1 and 3 complete turns of 360 degrees per turn is sufficient to draw the eyepieces towards each other. In this way, the nominal spacing 67 of FIG. 2 is reduced to a reduced nominal spacing 67.1 as shown in FIG. 13, typical between 1 and 3 millimeters smaller than the maximum nominal spacing 67 of FIG. 2.

Clearly, rotation of one eyepiece relative to the other twists the headband 18, and to eliminate the one or more twists, one of the swivel connectors 49 or 55 is rotated in an opposite direction to the goggles to remove the twist in the headband. Similarly to the eyepieces of the goggles, the anchor portions of the swivel connector must also be rotated a complete whole number of revolutions relative to each other, which number must equal the number of turns of the eyepieces.

Material Considerations

The selection of materials for the present invention is important as the physical characteristics of each of the three main components, namely the eyepiece lenses, the eyepiece frames and the nosebridge, differ considerably. Examples of suitable commercially available plastics are given below.

The eyepiece lens 35 is made from a relatively stiff and hard transparent plastic, with good scratch resistance and optical qualities. A suitable plastic is a polycarbonate material, for example as manufactured by Eastman Corporation and sold under the name TENITE PROPIONATE HT Series 382. This material has a Rockwell hardness on the R-scale of 88 using ASTM method D785, a flexural modulus of 1,655 MPa using ASTM method D790, and a tensile stress at yield of 36.5 MPa using ASTM method D638 (50 mm/min).

The nosebridge 17 is made from a slightly more resilient and tough plastic, for example, a polyamide material such as a nylon sold under the trade-mark NYLEX as manufactured by Multibase Inc. under code 1230 NAT. This material has a tensile strength of 3051 PSI using ASTM method D638, and a flexural modulus at R.T. of 122,000 PSI using ASTM method D790. This material also has a flexural strength of 3000 PSI using ASTM method D790, and an ultimate elongation of 159 percent using ASTM method D638.

The eyepiece frame 37 is made from a highly resilient and soft, rubber-like material, for example, a material such as SANTOPRENE™ as manufactured by Monsanto Inc.

This material has approximate physical properties as follows:

(a) Shore A hardness with a 10 second delay of 54.

(b) Tensile strength at break of 1062 PSI in the flow direction, and 1172 PSI in the cross direction.

(c) Elongation at break of 716 percent in the flow direction and 788 percent in the cross direction.

(d) Tear strength of 202 pounds force per inch in the flow direction and 222 in the cross direction.

(e) 100 percent modulus of 308 PSI in the flow direction and 264 PSI in the cross direction.

(f) 300 percent modulus of 546 in the flow direction and 440 PSI in the cross direction.

The examples given above are representative of the three main materials used in successful samples, but clearly, many equivalents can be substituted. It is also important that there is good bonding capability between the material of the eyepiece lens and the eyepiece frame to ensure that there is a chemically strong, watertight joint between the eyepiece frame and the eyepiece lens, which would resist any tensile forces applied thereto due to headband tension during normal use of the goggles.

Dimensional Considerations

Figure 6:
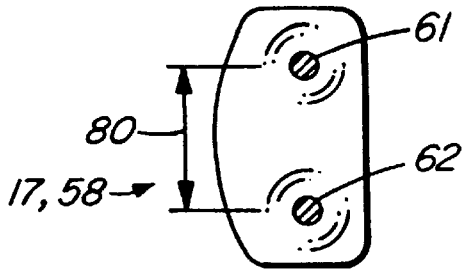
FIG. 6 is a simplified section on line 6—6 of FIG. 4.

Apart from the correct selection of plastic material for the nosebridge, it is also important that the filaments have proper dimensions which are selected to attain the desired result, particularly for maintaining the arch-like shape of the nosebridge when in the operative position and subjected to headband tension and also the twisting if required. For the particular NYLEX material described above, it has been found that the following dimensions provide a satisfactory nosebridge, the dimensions being measured when the nosebridge is aligned in the "as-molded position" as shown in FIGS. 4–6.

| | Millimetres | |
|---|---|---|
| Dimensional Measurement | Eg. | Range |
| Axial spacing between connector shoulders (125–128) of connection portions (57, 58) | 23.5 | ±5 |
| Minimum diameter of filament (61, 62) at | 0.7 | ±0.5 |

-continued

| Dimensional Measurement | Millimetres Eg. | Millimetres Range |
|---|---|---|
| central portion thereof (83, 84) | | |
| Maximum dimesion of filament (61, 62) adjacent root portion (87, 90) | 1.5 | ±1 |
| Maximum diameter of root portion (61, 62) immediately adjacent connector portion (57, 58) | 2.5 | ±1.25 |
| Lateral spacing (80) between centre lines of filaments (61, 62) | 5.5 | ±2.5 |

Operation

For many persons, there is no need to twist the filaments of the nosepiece, and the goggles are used in a normal manner, following routine adjustment of length of the headband 18. Small adjustments for variations in eye spacings between different wearers can usually be accommodated by positioning the goggles in appropriate locations adjacent the wearer's eyes and causing mild deformation of the arch shape of the nosebridge 17 which would permit adjustment of about 1 millimeter of the nominal spacing 67, (FIG. 2). However, for persons having smaller faces, or eyes more closely spaced together, one or more complete twists can be imparted to the filaments 61 and 62 to produce the twisted portions 206 as shown in FIGS. 12 and 13. Adjusting spacing between the left hand and right hand eyepieces is effected by positioning the goggles in a generally operative position about the longitudinal axis 15 (FIG. 1) and rotating one eyepiece relative to the other eyepiece about the nosebridge longitudinal axis 71 (FIG. 4) through at least one complete revolution so that the central portions 83 and 84 of the filaments are twisted together, thus reducing spacing between the eyepieces. If the initial reduction of the spacing 67 is insufficient, the eyepieces can be twisted again through one or more complete revolutions. Any twist of the nosebridge requires a corresponding twist of the swivel connector to remove any twists in the headband that would otherwise occur. The latch of the swivel connector maintains the anchors in a particular aligned configuration. Clearly the eyepiece spacing can be easily adjusted without separation of the nosebridge from the goggles, thus contrasting with many prior art goggles.

For most persons, two or three complete twists of the eyepieces is sufficient to attain minimum eyepiece spacing, typically about 3 mm less than the nominal spacing 67. It is noted that the physical properties of the nosebridge material is such that when the goggles have been used for some time, eg. a few hours with the filaments twisted as shown in FIGS. 12 and 13, there is a tendency for the nosebridge to remain twisted thus maintaining desired eyepiece separation for that person. Thus the nosebridge material is selected to have a relatively low memory when cold formed by twisting, as shown, and this low memory tendency is augmented by immersion of the goggles in water, which further decreases long term memory and any residual tendency for the goggles to return to an untwisted condition.

Clearly, spacing between the eyepieces can be increased again from the decreased size by twisting the goggles in a reverse direction with a corresponding twist(s) on the swivel connector to remove any twist in the headband. If the nosepiece is fully untwisted to resume the configuration shown in FIGS. 1 and 2 it does not take very long (eg. a few hours) for any residual twists in the filaments to be removed and the goggles returned to their essentially untwisted state.

It is noted that the interference fit between the projection and the respective recess is sufficient to prevent essentially any movement between the nosebridge connection portion and the respective recess. Also, because the outer portions of the filaments are sufficiently stiff to effectively cantilever the filaments from the connector portions, any twists in the nosebridge causes a negligible reduction in height of the nosebridge above the nose of the wearer, thus reducing the chances of the nosebridge, when twisted, from approaching the wearer's nose to cause discomfort.

The stiffness of the root portions 87–90 of the filament is such that when the nosepiece has been twisted as shown in FIGS. 12 and 13, there is little change in the overall shape of the nosepiece, thus maintaining adequate clearance between the nosebridge and the wearer's nose.

ALTERNATIVES

The nosebridge 17 is shown with twin filaments 61 and 62 but, for some applications, it may be desirable to increase the number of filaments to three. Increasing the number of filaments to more than four would likely be counterproductive as filaments on the outside of the nosebridge would likely be stressed to a greater extent than those on the inside, causing premature failure of the filaments on the outside of the nosebridge with little other benefits to be gained.

The invention is shown with a pair of generally similar swivel connectors 49 and 55, but in practice only one swivel connector is required, permitting use of a non-swivelling connector at the opposite end of the headband.

The recess shoulder 145 is shown to extend completely around the recess 143 of the boss or joint portion 141 and the recess shoulder is located within a single plane, ie. all portions of the recess shoulder are coplanar. This requires the connector shoulders 125–128 of the connector portions 57 and 58 to be similarly coplanar with each other so as to be complementary to the coplanar recess shoulder. Clearly, other arrangements of complementary shoulders can be designed to be compatible with each other, and portions of the connector shoulders or recess shoulder do not need to be coplanar with each other. In addition, the shoulders do not have to be generally perpendicular to the projection and complementary recess, but could be inclined obliquely thereto. It is important that there is a snug fit between the projection and the recess, and between the connector shoulders and the recess shoulders so as to reduce chances of inadvertent movement between the nosebridge and the eyepieces, thus reducing any tendency of the filaments to move inwardly towards each other, which would tend to aggravate the chances of the nosebridge from contacting the wearer's nose.

Also, while the projection is shown to have a pair of projection steps 109 and 110 associated with the bulge portions 103 and 104, there would probably be sufficient grip if only one projection step was provided. Alternatively, projection steps on the narrow faces of the projection could be substituted or additionally be provided with corresponding recess steps on the narrow faces 161 and 162 of the recess.

What is claimed is:

1. A nosebridge for eye goggles comprising:

(a) left hand and right hand connector portions which are connectable to respective eyepieces of the goggles; and (b) first and second filaments, each filament having left and right hand end portions connected to the respective connector portions, the end portions being spaced laterally apart and having root portions which flare smoothly from an adjacent end portion of the filament to merge smoothly with the respective connector portion through a generally conical fillet whereby the root portions are non-hingedly connected to the connector portion to extend rigidly therefrom.

2. A nosebridge as claimed in claim 5 in which each connector portion thereof comprises:

(a) a projection; and (b) the root portions have an overall size greater than the projection to provide at least one connector shoulder, the connector shoulder extending from at least one face of the projection and being locatable against a respective eyepiece to provide a rigid connection therewith.

3. A nosebridge as claimed in claim 2 in which:

(a) the projection has a proximal portion adjacent the connector shoulder, and a distal portion remote therefrom, the distal portion having a size greater than the proximal portion to provide a bulge with a first projection step on a first projection face.

4. Eye goggles comprising:

(a) left hand and right hand eyepieces, the eyepieces having inner portions and outer portions; and (b) a nosebridge for interconnecting the inner portions of the eyepieces, the nosebridge having left hand and right hand connector portions and first and second filaments, each filament having left hand and right hand end portions connected to the respective connector portions; and (c) a headband cooperating with outer portions of the eyepieces to extend therebetween.

5. A Eye goggles as claimed in claim 4 in which:

(a) the end portions of each filament connected adjacent each respective connector portion are spaced laterally apart.

6. Eye goggles as claimed in claim 5 in which:

(a) the end portions of each filament have root portions which are non-hingedly connected to the connector portions so as to extend essentially rigidly therefrom.

7. Eye goggles as claimed in claim 4 in which:

(a) each root portion resembles a generally conical fillet which flares smoothly from an adjacent end portion of the filament to merge smoothly with the respective connector portion.

8. Eye goggles as claimed in claim 4 in which:

(a) the inner portion of each eye piece has a joint portion with a recess therein; and (b) the left hand and right hand connector portions each have a respective projection which is receivable within the recess of the respective eyepiece to connect the nosebridge to the respective eyepiece.

9. Eye goggles as claimed in claim 8 in which:

(a) the joint portion of each eyepiece has a recess shoulder located adjacent the respective recess and disposed generally parallel to the eyepiece lens, the recess being disposed generally perpendicularly to the recess shoulder; and (b) each connector portion has an overall size greater than the projection to provide at least one connector shoulder extending from the projection and being located against a recess shoulder of the respective eyepiece to provide a rigid connection therewith.

10. Eye goggles as claimed in claim 9 in which:

(a) the recess shoulder of each joint portion extends on at least two sides of the respective recess, portions of each recess shoulder being coplanar with each other; and (b) the connector shoulder of each connector portion extends from at least two sides of the projection and are coplanar with each other, the recess shoulders and the projection shoulders being generally complementary to each other to provide a rigid connection therebetween.

11. Eye goggles as claimed in claim 8, in which:

(a) the recess of each joint portion has a first recess face having a first recess step; and (b) the projection has a proximal portion adjacent the connector shoulder, and a distal portion remote therefrom, the distal portion having a size greater than the proximal portion to provide a bulge with a first projection step on a first projection face of the projection, the projection step being engaged with the recess step to hold the projection in the recess.

12. Eye goggles as claimed in claim 11, in which:

(a) the recess of each joint portion has a second recess face having a second recess step, the first and second recess faces facing toward each other; and (b) the bulge of the projection provides a second projection step on a second projection face of the projection, the first and second recess steps being engaged by the first and second projection steps when the recess receives the projection so as to hold the projection in the recess.

13. Eye goggles as claimed in claim 11, in which:

(a) each connector portion has at least one projection shoulder; and (b) each joint portion has at least one recess shoulder to contact the projection shoulder when the first recess step is engaged by the first projection step.

14. Eye goggles as claimed in claim 4 further comprising:

(a) a swivel connector extending between one end portion of the headband and an outer portion of one eyepiece to permit relative swivelling between the headband and the eyepiece.

15. Eye goggles as claimed in claim 14 in which:

(a) the swivel connector has a band anchor portion connected to an end portion of the headband, and an eyepiece anchor portion cooperating with an outer portion of an eyepiece, the anchor portions being rotatable relative to each other to permit swivelling about a swivel axis interconnecting the anchor portions.

16. Eye goggles as claimed in claim 14, in which the swivel connector further comprises:

(a) a swivel latch cooperating with the anchor portions to releasably latch together the anchors in a particular aligned configuration.

17. Eye goggles as claimed in claim 15, in which:

(a) one anchor portion comprises first and second swivel body portions having respective concave journal halves which cooperate with each other to form an annular female swivel journal; and (b) the other anchor portion comprises a spigot having a cylindrical spigot root to form a male swivel journal complementary to the female swivel journal, and a spigot head which is larger than the spigot root to prevent unintentional separation of the spigot from the female swivel journal.

18. A method of adjusting spacing between two eyepieces of eye goggles, in which the eyepieces are interconnected with at least two filaments, the method comprising:

(a) positioning the goggles in a generally operative position; and (b) rotating one eyepiece relative to the other eyepiece through at least one revolution so that portions of the filaments are twisted together, thus tending to reduce spacing between the eyepieces.

19. A method as claimed in claim 18 in which, (a) in the generally operative position, the goggles are positioned about a longitudinal goggles axis; and (b) the goggles are rotated about a longitudinal nosebridge axis which is generally parallel to the goggles axis.

20. A method as claimed in claim 18 in which adjacent end portions of the filaments are spaced generally laterally apart, the method being further characterized by:

(a) permitting at least said end portions of the filaments to remain spaced apart following relative rotation of the eyepieces.

21. A method as claimed in claim 18 in which outer portions of the eyepieces are connected together with a headband, the method being further characterized by:

(a) after the relative rotation of the eyepieces, permitting one end of the headband to swivel with respect to the adjacent eyepiece so as to essentially eliminate twisting of the headband.

22. A method as claimed in claim 18 further comprising:

(a) causing the end portions of the filaments to extend generally perpendicularly from the eyepiece axis so as to be non-hingedly connected thereto.

* * * * *